United States Patent [19]

Huffman et al.

[11] 4,377,254

[45] Mar. 22, 1983

[54] CENTRIFUGE HOLDER APPARATUS

[75] Inventors: Eric C. Huffman, Santa Clara; James F. Woodall, Mountain View, both of Calif.

[73] Assignee: Beckman Instruments, Inc., Fullerton, Calif.

[21] Appl. No.: 277,792

[22] Filed: Jun. 29, 1981

[51] Int. Cl.[3] ..... B04B 7/02; B04B 15/00

[52] U.S. Cl. ..... 494/12; 68/3 R; 248/680; 494/60

[58] Field of Search ..... 233/1 A, 1 R, 1 C, 1 B, 233/23 A, 27, 23 R, 24, 25, 26; 68/3 R; 248/680, 681, 500, 300

[56] References Cited

U.S. PATENT DOCUMENTS

| | | | |
|---|---|---|---|
| 1,481,396 | 1/1924 | Ternes | 248/680 |
| 1,865,584 | 7/1932 | Perry | 233/1 B |
| 2,783,938 | 3/1957 | Grela | 233/1 B |
| 3,388,885 | 6/1968 | Holmes | 248/500 |

*Primary Examiner*—Robert W. Jenkins

*Attorney, Agent, or Firm*—R. J. Steinmeyer; F. L. Mehlhoff; William H. May

[57] ABSTRACT

A centrifuge holder to inhibit movement of a centrifuge machine caused by a rotor within the centrifuge coming off the drive spindle. The holder apparatus is designed in such a manner that the centrifuge machine can be placed on or removed from the holder without the need of any separate tool. Tab members of the holding apparatus are received within spaced apertures located in the bottom of the centrifuge.

3 Claims, 6 Drawing Figures

CENTRIFUGE HOLDER APPARATUS

BACKGROUND OF THE INVENTION

The present invention is directed to centrifuges and, more specifically, is directed to a holder apparatus designed to prevent any rotational movement of a centrifuge machine on the support surface upon which it is rested.

Centrifuge machines are designed to operate centrifuge rotors at high speeds in order to produce the necessary forces to accomplish the separation of each of the fluid samples located within the rotor. Since the speeds of the rotors are very high, much concern exists with respect to ensuring that the rotor maintains its proper position within the centrifuge machine. Otherwise, the interior of the centrifuge machine may be damaged. In some instances the balance loading in the rotor is inadvertently not achieved prior to the operation of the centrifuge. An unbalanced load on the rotor may cause possible disengagement of the rotor from the drive spindle or actual breakage of the drive spindle in the centrifuge. The result of such a circumstance would be damage not only to the rotor and the fluid samples, but also to the interior of the centrifuge machine in which the rotor is contained. The centrifuge machine is designed in such a manner that a disengaged rotor is contained safely within the centrifuge.

Some centrifuge machines are relatively small for use on a work table. The weight of these machines is lighter than some of the relatively large ultra-centrifuge machines that are designed for positioning on a floor. In the event of an unbalanced rotor condition in the centrifuge the rotor may become disengaged and thrash around in the rotor chamber. The forces generated by the loose rotor may cause the centrifuge machine to move around the table. Such a condition is highly undesirable in that there is the possibility of damage to other equipment on the table as well as possible harm to operators who may be in the vicinity.

The amount of torque and motion caused by the rotor within the rotor chamber when it thrashes around after breakage of its drive spindle caused by rotor imbalance will result in a rotative motion in the centrifuge machine itself. In the case of a table top type of centrifuge machine which is small and relatively lightweight, the centrifuge is not able to withstand the forces generated, resulting in a reactive motion in the centrifuge itself.

Some solutions to this problem have been to physically bolt the centrifuge machine to a fixed location on the table top. However, this approach would require the undesirable need to remove the bolts or other fastening means every time the centrifuge machine is to be moved.

SUMMARY OF THE INVENTION

The present invention is directed to a holder assembly which is designed in such a manner that the centrifuge machine can be easily moved in a vertical direction with respect to the support surface upon which it rests while at the same time a rotational movement of the centrifuge machine will be inhibited. The holder assembly incorporates the use of a pair of vertically projecting tabs from a mounting plate which is securely fastened to a support table. The tabs are designed to be received within spaced slots in the bottom of the centrifuge machine. Also in these projecting tabs of the holder are horizontal slots with their open ends oriented 180° with respect to each other.

If any rotational motion occurs in the centrifuge machine, the slots within the tabs would hold on to the bottom panel of the centrifuge machine. The holding assembly is designed in such a manner that it allows the centrifuge to be lifted and easily moved without the use of any tools. The holder assembly will interface with the centrifuge in such a manner that it will not physically contact the centrifuge during normal usage. The dampening function of the centrifuge leg pads will not be impaired as would be the case with respect to a holder that is affixed to the centrifuge and bolted to the work table. The present holding assembly will only contact the centrifuge when the centrifuge starts to move. Further, the holder is designed to be not only functional in use, but also efficient in its manufacture.

DETAILED DESCRIPTION OF THE INVENTION

Figure 1:
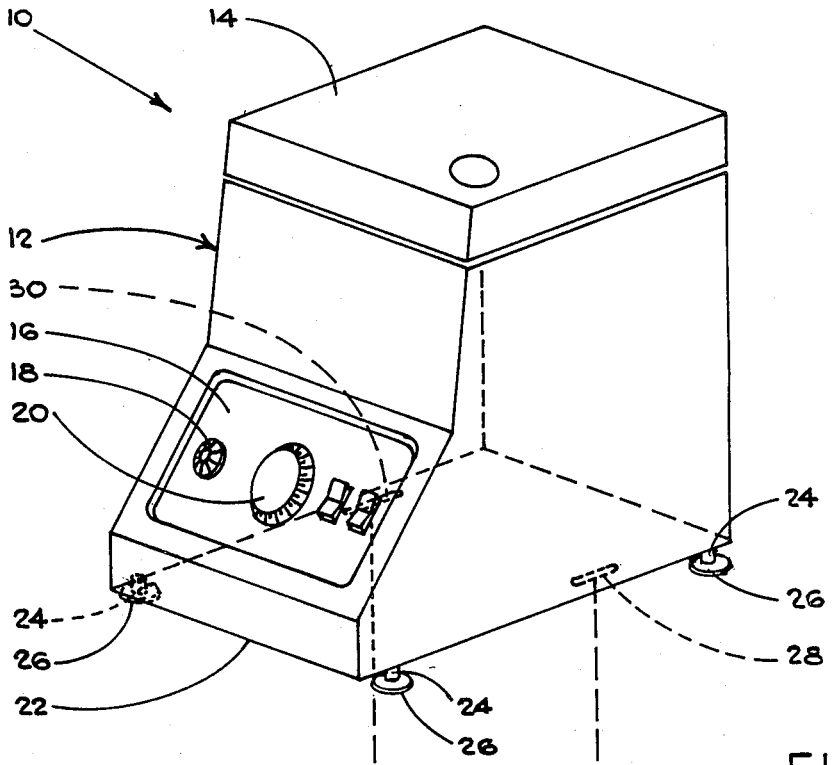
FIG. 1 is a perspective view of a table top centrifuge.

Attention is directed to FIG. 1 showing a table top centrifuge 10 having a rotor cabinet 12 with a removable lid 14. When the lid 14 is open, a rotor chamber, not shown, would be in view containing a drive spindle on which the rotor is placed for centrifugation of fluid samples. Located on a front panel 16 of the centrifuge are control knobs 18 and 20 designed for the control and the operation of the centrifuge. The centrifuge machine has a bottom panel 22 from which project four support legs 24. The legs 24 have pads 26 which are designed to provide secure frictional attachment between the centrifuge 10 and the support surface on which it will rest.

The table top centrifuge 10 is designed for operation to drive a rotor at approximately 12,000 r.p.m.'s. As explained previously, if a rotor is placed in the centrifuge in an unbalanced condition, it could come off of or break its drive spindle and thrash around within the rotor chamber of the centrifuge. This impact of the rotor in the rotor chamber will cause motion in the centrifuge 10, because its weight is not sufficient to restrain the forces being generated by the rotor moving within the centrifuge. The result would be the movement of the centrifuge 10 on the support table.

Figure 2:
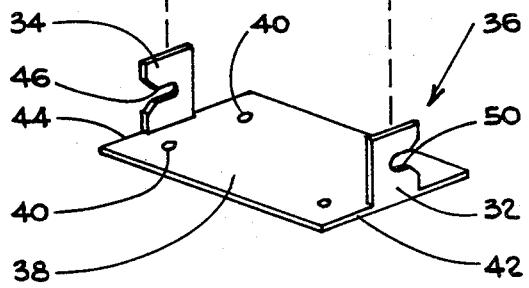
FIG. 2 is a perspective view of a holder device of the present invention.
Figures 3, 4, 5:
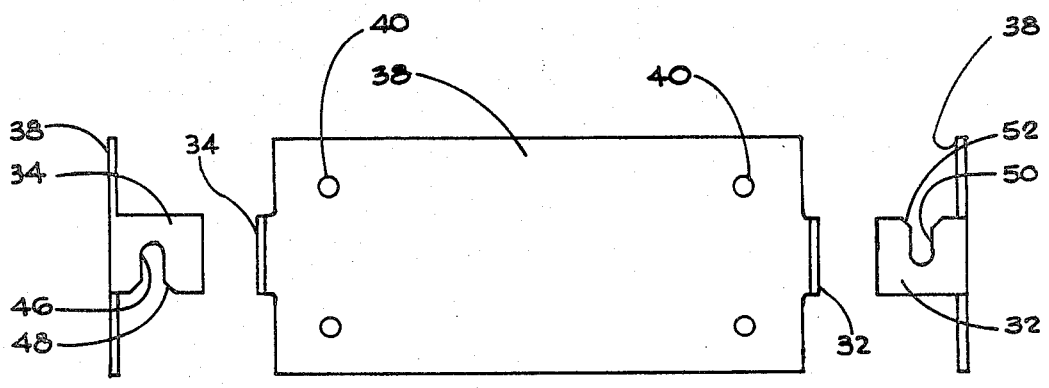
FIG. 3 is a top view of the holder device of the present invention.
FIG. 4 is one end view of the holder of the present invention.
FIG. 5 is the other end view of the holder of the present invention.
Figure 6:
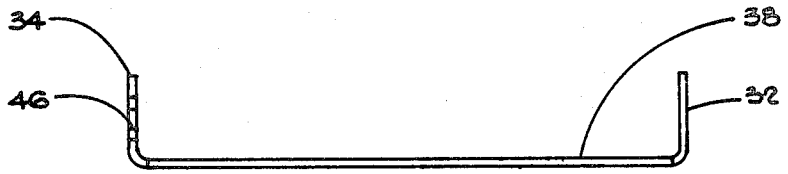
FIG. 6 is a side view of the holder of the invention.

Located in the bottom panel 22 of the centrifuge are apertures 28 and 30. These apertures are designed to receive the respective projecting tabs 32 and 34 of a holding member 36 shown in FIG. 2. The holder 36 has a mounting plate 38 with a plurality of apertures 40 designed to receive bolts or screws, not shown, for securing the mounting plate 38 to a support table or surface. The tabs 32 and 34 project from the respective ends 42 and 44 of the mounting plate 38. As shown more clearly in FIG. 6, the respective tabs 32 and 34 project at an approximate 90° angle from the mounting plate 38. As shown in FIG. 4, the tab 34 has a connecting slot 46 with an open tapered end 48. Similarly, in FIG. 5 the tab 32 has a connecting slot 50 which has an open tapered end 52. However, the open end 48 of the slot 46 is facing in a direction 180° opposed to the direction of the opening 52 of slot 50 in the tab 32. Preferably, the mounting or holding bracket 36 is made of a strong material, such as metal, which can withstand any movement impacted on it by the centrifuge 10.

The use of the present invention is accomplished by locating a particular area on a work table where the centrifuge machine is to be used. At that location the mounting bracket 36 is secured to the surface by the use of bolts or screws or any other type of attachments, such as clamps or a strong adhesive. The centrifuge 10 is then lowered over the holding member 36 so that the interconnect tabs 32 and 34 are received within the apertures 29 and 30 in the bottom panel 22 of the centrifuge. It should be noted that the length of the apertures 28 and 30 is such that it is larger than the width of the projecting tabs 32 and 34 to permit ease in the placement and removal of the centrifuge 10 on the holder 36.

If during operation of the centrifuge the rotor comes off the drive spindle, the continued rotative motion of the rotor will impart a similar rotative motion to the whole centrifuge. The motion of the centrifuge will be in a rotational motion and will result in the somewhat thin bottom panel 22 of the centrifuge being gripped adjacent the apertures 28 and 30 by the slots 50 and 46 of the projecting tabs 32 and 34. Consequently, movement of the centrifuge machine 10 is restricted and will remain in a secure position on the table until the rotor has come to rest within the centrifuge. The slots 50 and 46 within the tabs 32 and 34 are oriented so that they face in a direction opposite the rotational movement of the rotor. Since the movement of the rotor will cause a similar directional rotational movement in the centrifuge 10, the centrifuge will be gripped by the slots 50 and 46 in the projecting tabs 32 and 34.

Although a particular embodiment of the present invention is shown and described above, it is envisioned that similar bracket mechanisms of various designs could be utilized with slight modification, but remain within the scope of the present invention to accomplish the same end result of retaining the centrifuge in a fixed position while at the same time permitting ease in the positioning and removal of the centrifuge from the support table.

What is claimed is:

1. A centrifuge holder assembly comprising:

a centrifuge machine for operating a rotor and having a bottom panel with at least two apertures;

a mounting plate;

means for securely fastening said plate to a horizontal surface on which said centrifuge machine rests; and means connected to said plate and projecting toward said centrifuge machine for interfacing with said apertures, said interfacing means designed in such a manner to engage and secure said centrifuge when said centrifuge begins to move horizontally, said interfacing means preventing any significant rotational movement of said centrifuge.

2. A centrifuge holder assembly as defined in claim 1, wherein said interfacing means comprises:

a tab located on at least two ends of said plate and projecting away from said surface for receipt in said apertures; and means on said tabs for holding said centrifuge if said centrifuge moves in a rotational manner on said surface.

3. A centrifuge holder assembly as defined in claim 2, wherein said holding means comprises a generally horizontal slot in one of said tabs with an opening facing in one direction and a generally horizontal slot in the other of said tabs with an opening facing in a direction generally opposite to said one direction of said one tab, said slots engaging said bottom panel when said rotational movement occurs.

* * * * *